United States Patent [19]

Stark

[11] Patent Number: 4,656,058

[45] Date of Patent: Apr. 7, 1987

[54] PAINT SHIELDS AND PAINTING METHODS

[76] Inventor: William C. Stark, 306 S. Almansor St., Alhambra, Calif. 91801

[21] Appl. No.: 764,743

[22] Filed: Aug. 9, 1985

Related U.S. Application Data

[63] Continuation-in-part of Ser. No. 176,390, Aug. 8, 1980, abandoned, and a continuation-in-part of Ser. No. 495,300, May 16, 1983, and a continuation-in-part of Ser. No. 571,582, Jan. 17, 1984, abandoned.

[51] Int. Cl.[4] ..... B05C 11/16; B05D 1/32; B05D 5/00

[52] U.S. Cl. ..... 427/282; 118/504; 118/505; 427/401

[58] Field of Search ..... D7/6; 118/504, 505; 156/278, 280; 220/8; 427/282, 401

[56] References Cited

U.S. PATENT DOCUMENTS

| | | | |
|---|---|---|---|
| D. 193,586 | 9/1962 | Eicholtz | D7/6 |
| D. 213,546 | 3/1969 | Noel | D7/6 |
| D. 221,155 | 7/1971 | Schorci et al. | D7/6 |
| D. 223,704 | 5/1972 | Chekiozc | D7/6 |
| 21,955 | 1/1858 | Grosholz | 230/8 |
| 61,084 | 1/1867 | Millar | 220/8 |
| 2,358,151 | 9/1944 | Duggan | 118/505 |
| 2,880,902 | 4/1959 | Owsen | 220/8 |
| 2,925,064 | 2/1960 | Kahn | 118/505 |
| 3,335,703 | 8/1967 | Buehler | 118/504 |
| 3,722,470 | 3/1973 | Farrell | 118/505 |
| 4,168,676 | 9/1979 | Itoh | 118/504 |
| 4,195,590 | 4/1980 | Herrington | 118/505 |
| 4,196,692 | 4/1980 | Varstrom | 118/504 |

FOREIGN PATENT DOCUMENTS

| | | | |
|---|---|---|---|
| 563251 | 3/1974 | Switzerland | 118/504 |
| 18938 | of 1914 | United Kingdom | 118/504 |

*Primary Examiner*—Michael R. Lusignan
*Attorney, Agent, or Firm*—Benoit Law Corporation

[57] ABSTRACT

Self-supporting paint shields have at an end thereof a continuously annular wall portion defining an opening for receiving a circular object to be shielded. This annular wall portion has around that opening a tapering brim and has across that opening a diameter different from a diameter of that circular object. The annular wall portion is adaptable in diameter to the circular object and is adapted to extend with its tapering brim to a surface to be painted, while the continuously annular wall portion is in contact with the circular object at the mentioned end, thereby exerting a gripping action supporting the paint shield on the circular object. The paint shields preferably have a circumferential bevel extending in a continuous transition from an outer shield surface to the paint shield opening. Such opening preferably is smaller in diameter than the circular object, and the paint shield is twisted at the annular wall portion onto that object.

55 Claims, 15 Drawing Figures

FIG. 4
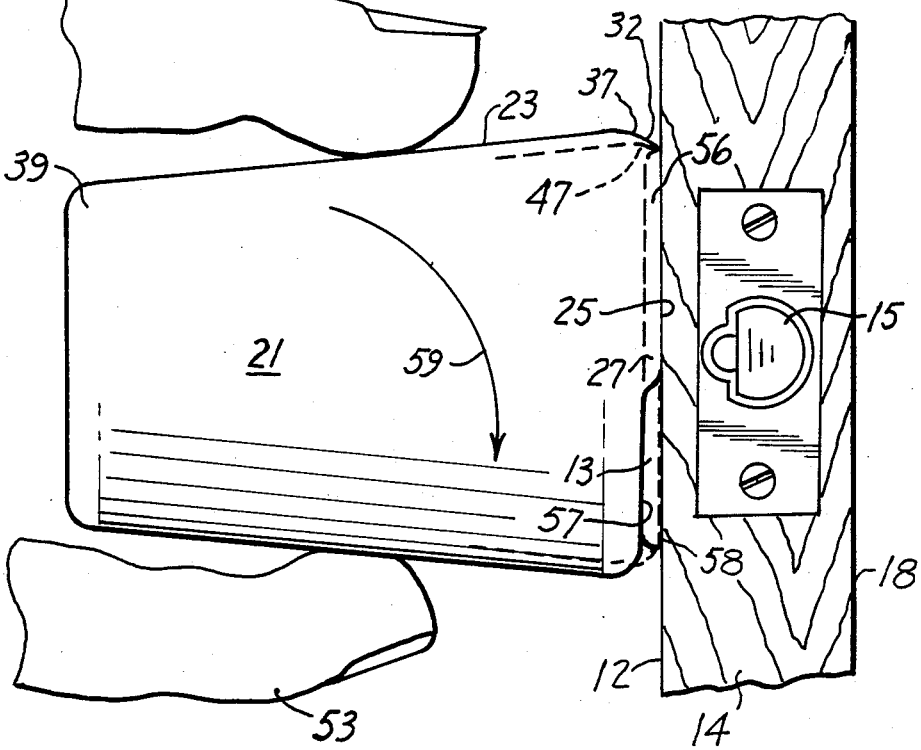
FIG. 5
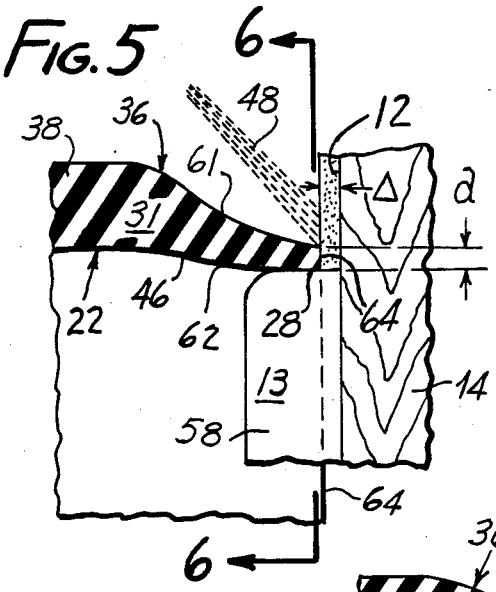
FIG. 6
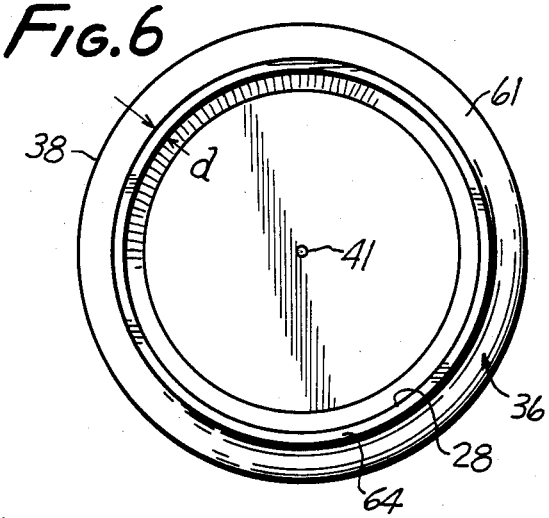
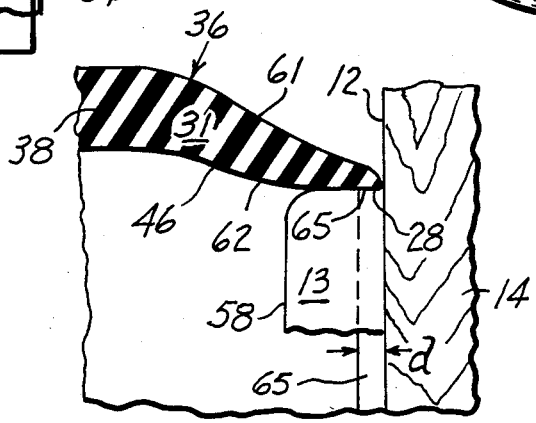
FIG. 7

PAINT SHIELDS AND PAINTING METHODS

BACKGROUND OF THE INVENTION

Cross-References

This is a continuation-in-part of my copending patent application Ser. No. 06/176,390, filed Aug. 8, 1980, now abandoned, for Paint Shields and Paint Shielding Methods, of my copending patent application Ser. No. 06/495,300, filed May 16, 1983 for Paint Shields and Painting Methods, and of my copending patent application Ser. No. 06/571,582, now abandoned, filed Jan. 17, 1984 for Paint Shields and Painting methods; all three of these copending patent applications being hereby incorporated by reference herein.

Field of the Invention

The subject invention relates to painter's equipment and painting methods and, more specifically, to methods of applying paint to a surface exclusive of a shielded further surface or object, to work and object surface shields, masks and protectors, and to paint shields and shielding assemblies.

Information Disclosure Statement

This information disclosure statement is made pursuant to the duty of disclosure imposed by law and formulated in 37CFR 1.56(a). No representation is hereby made that information thus disclosed in fact constitutes prior art inasmuch as 37CFR 1.56(a) relies on a materiality concept which depends on uncertain and inevitably subjective elements of substantial likelihood and reasonableness, and inasmuch as a growing attitude appears to require citation of material which might lead to a discovery of pertinent material though not necessarily being of itself pertinent.

The current proliferation of high-pressure spray guns among unskilled people, such as through purchase or rental from wholesale paint stores, is giving rise to various problems including serious hand injuries which are difficult to treat as, for instance, reported in an article by Cameron A. Gillespie, M.D., et al, entitled "Airless Paint Gun Injuries: Definition and Management," which appeared in THE AMERICAN JOURNAL OF SURGERY, Vol. 128, September 1974, pp. 383–391. Reference should also be had to an article by Herbert H. Stark, M.D. on "Paint-Gun Injuries of the Hand," which appeared in THE JOURNAL OF BONE AND JOINT SURGERGY, Vol. 49-A, No. 4, pp. 637–647, June 1967. As apparent from that article, high-pressure airless spray guns bring about serious and tragic injuries not readily preventable by existing safetey devices. Also, as apparent from CONSUMER REPORTS, June 1978, p. 333, the Consumer Product Safety Commission found many existing guards ineffective to provide the requisite protection. Moreover, general practitioners do not necessarily know how a paint injection injury should be treated, thereby increasing their danger, as apparent from ABSTRACTS, Vol. 62, No. 3, summarizing an article by Dr. C. M. Booth, entitled "High Pressure Paint Gun Injuries," from the British Medical Journal, 1333, 1977. Furthermore, spray gun injuries frequently are difficult to detect on admission of the patient, as noted in an article by Erkki O. Karaharju and Pär Slätis, entitled "Angiography after Paint-Gun Injury of the Hand: a Case Report," which appeared in INJURY, Vol. 9, pp. 66–67, and in an article by John J. Silsby, M.D. entitled "Pressure Gun Injection Injuries of the Hand," and having appeared in THE WESTERN JOURNAL OF MEDICINE, 125: 271–276, October 1976.

Not only as a matter of convenience, but also from a safety point of view, efforts to provide paint shields enabling painters to keep their hands away from areas being painted thus command a very high priority.

There certainly has been no dearth of proposals in the area of paint shields, painting techniques, wall protectors, surface guards and the like, as may, for instance, be seen from the wall protector disclosed in U.S. Pat. No. 456,775, issued July 28, 1891, the wall protector disclosed in U.S. Pat. No. 624,796, issued May 9, 1899, the wall protecting device disclosed in U.S. Pat. No. 695,965, issued Mar. 25, 1902, the elaborately angled paint guard of U.S. Pat. No. 1,386,706, issued Aug. 9, 1921, the mop board protector of U.S. Pat. No. 1,563,889, issued Dec. 1, 1925, the tool disclosed in U.S. Pat. No. 1,851,497, issued Mar. 29, 1932, the painter's masking shield of U.S. Pat. No. 2,290,472, issued July 21, 1942, the shield for wall moldings of U.S. Pat. No. 2,332,579, issued Oct. 26, 1943, the guard for use in painting and cleaning operations of U.S. Pat. No. 2,517,220, issued Aug. 1, 1950, the wall protector of U.S. Pat. No. 2,538,743, issued Jan. 23, 1951, the surface masking shield of U.S. Pat. No. 2,672,122, issued Mar. 16, 1954, the spray shield of U.S. Pat. No. 2,842,093, issued July 8, 1958, the painting mask of U.S. Pat. No. 2,959,152, issued Nov. 8, 1960, the painters' door shield of U.S. Pat. No. 3,029,782, issued Apr. 17, 1962, the work attached paint shield of U.S. Pat. No. 3,380,435, issued Apr. 30, 1968, the baseboard protecting shield of U.S. Pat. No. 3,422,798, issued Jan. 21, 1969, the interior decorators' aid disclosed in British Patent Specification No. 1 400 406, published July 16, 1975, the paint shielding apparatus of U.S. Pat. No. 4,085,703, issued Apr. 25, 1978, the coating technique and apparatus of U.S. Pat. No. 3,415,675, issued Dec. 10, 1968, and the door casing hardware paint shield disclosed in U.S. Pat. No. 4,195,590, issued Apr. 1, 1980. For completeness' sake, reference may also be had to the picture frames of U.S. Pat. No. 3,237,332, issued Mar. 1, 1966, and U.S. Pat. No. 4,023,293, issued May 17, 1977, which would, however, not be practically usable as paint shields and which are not being proposed for this purpose.

Despite this seeming wealth of proposals, there persisted a heretofore unsatisfied need for practical and highly efficient spray shields contributing to the safety of painters from spray paint injuries, and for practical, highly efficient and safe painting methods.

In this respect, one may, for instance, consider the traditional and persistently followed approach to the painting of doors.

According to one prevailing approach, the installation of door knobs and cover plates is deferred until after the door has been painted. In practice, this introduces time delays and inefficiencies, particularly in large construction projects where the installation of the door and its final outfitting have to be conducted at different intervals.

Another prevailing approach to the painting of doors employs adhesive masking tape, which has to be carefully applied to and around the door knob and cover plate to shield the same when paint is being applied to the surface of the door. A particularly frequent application of this method concerns the repainting of previously painted doors in homes and in various private and public buildings.

In practice, the masking tape method is awkward, time consuming and requires considerable labor. Also, the adhesive of the masking tape tends to leave a residue on the masked surfaces, and the tape cannot always in practice be applied with the precision required for a satisfactory job.

For these and similar reasons, many painters try to do the job without any masking at all, thereby almost invariably leaving unsightly paint dabs on the door knob.

What has so far been said with respect to door knobs and cover plates applies also to painting around other raised objects or closed geometrical shapes or surfaces. Yet, despite their inherent and practical drawbacks, the prior art has not been able to relegate the mentioned approaches to obsolescence and to provide truly efficient and practical and widely acceptable substitutes.

The inherent inefficiencies and other drawbacks of existing shielding technology under consideration stand in sharp contrast to the increasing efficiency of spray and other painting methods. In practice, such improvements are to a considerable extent nullified by inefficient shielding and masking techniques.

With the advent of spray guns, particularly of the airless type, which emit paint at high velocity and narrow angles, the use of hand-held shields has proliferated. However, as shown in the above articles, that exposes the painter to real danger when relatively small objects or surfaces are to be shielded, since the impact of high-velocity paint jets on a painter's skin can cause serious injuries including the loss of fingers and entire limbs.

In retrospect, it may appear curious that cups and similar vessels which have been around for a long time apparently have not been creatively applied to the paint shield field, despite the above mentioned pressing needs. However, a review of proposals in that field shows a persistent lack of an acceptable solution.

In this respect, U.S. Pat. No. 2,925,064, issued Feb. 16, 1960, discloses a door knob paint shield composed of two half shells. U.S. Pat. No. 3,722,470, issued Mar. 27, 1973, discloses a paint shield composed of two sheets secured to one another so that they can be bowed outwardly from each other. Swiss Pat. No. 563 251, issued May 15, 1975, discloses a door knob paint shield having a can attached to a handle, and points out that the diameter of door knob escutcheons to be shielded is somewhat smaller than the inside diameter of the can or hollow cylinder.

Accordingly, the paint shield according to that Swiss Pat. No. 563 251 is not self-supporting on the door knob. Rather, that paint shield can only be used for painting with a brush by hand, since it would have been too dangerous to use that paint shield for a high-pressure spray paint operation, given the fact that such paint shield, as disclosed in the cited Swiss patent, has to be held over the door knob with one hand. As has become known in recent years, serious injuries with loss of fingers or limbs can occur if a hand is hit by high-pressure paint.

In particular, the paint shield disclosed in the Swiss Pat. No. 563 251 has to be held at its handle with one hand, while a paint brush is conducted around part of that paint shield with the other hand. During such painting operation, the hands have to be changed, since it is not possible or practical to guide the paint brush with one hand entirely around the hand and arm with which the paint shield has to be held at its handle according to the cited Swiss patent.

In practice, this need to change hands somewhat broadens the unpainted halo inevitably resulting from the use of that paint shield.

The paint shield according to the above mentioned U.S. Pat. No. 3,722,470, by Farrell, similarly leaves unpainted corners at the door knob cover plate, since it is practically impossible to stretch that cornered oval paint shield into a strictly cylindrical configuration. Rather, that paint shield comes open at the seams when such complete stretching against its initial configuration is attempted. Even if it were somehow possible to remedy that drawback, there still would not be sufficient flexibility in the Farrell shield to accommodate different object diameters. Accordingly, Farrell, who expressly relies on the thinness of the material out of which his shields are made, also needs to rely on the provision of a plurality of scored lines 50 adapted to be severed by being torn so as to create new paint shield ends capable of fitting various bases or objects. In consequence, the Farrell shields need to be inversely tapered so as to permit adaptation to different base or object sizes by tearing of the paint shields along a score line 50.

This of course, not only limits the reusability of Farrell shields, but also makes these thin shields difficult to place on objects because of their inverse taper and tendency to come open at the seams.

Use of the paint shield according to the above mentioned U.S. Pat. No. 2,925,064 also leaves unpainted portions about the cover plate of the door knob, since spraying paint is able to reach the cover plate through the lateral longitudinal cracks shown in that patent between the half shields.

U.S. Pat. No. 2,358,151, issued Sept. 12, 1944, discloses a mask for shielding a shaft or similar raised object. However, that approach inevitably leaves a wide unpainted circular portion at any otherwise painted surface around the shaft.

Paint shields which work with suction cups as those disclosed in U.S. Pat. No. 3,335,703, issued Aug. 15, 1967, and British Patent Specification No. 18,938, A.D. 1914, as well as those operating with internal adjustment mechanisms, as disclosed in U.S. Pat. No. 4,196,692, issued Apr. 8, 1980, are similarly impractical for present purposes.

Low-profile cover plates and similarly dimensioned objects are particularly difficult to shield adequately, even with manually applied masking tape. Yet, large manufacturers, including the Schlage Lock Company, have been and are putting out door knob models having cover plates with a height at the rim on the order of one-eighth of an inch or three millimeters, herein referred to as "low-profile" cover plates or objects, and being very hard to mask properly.

No practical solution was afforded by drinking cups, including the collapsible cups of U.S. Pat. No. 21,955, issued Nov. 2, 1858, and U.S. Pat. No. 61,084, issued Jan. 8, 1867, and U.S. Pat. No. 2,880,902, issued Apr. 7, 1959, the tumbler of U.S. Pat. No. Des. 221,135, issued July 13, 1971, the cup of U.S. Pat. No. Des. 223,704, issued May 30, 1972 and the cup of U.S. Pat. No. 4,168,676, issued Sept. 25, 1979, all disclosing a frustoconical configuration up to the top opening and a rolled or rounded circular brim about such top opening.

In practice, a frustoconical configuration would work against a retention of such cup on any raised door knob or similar object, and the rolled or rounded circular brim would also promote the occurrence of unpainted rings on the surface adjacent to a shielded door knob or similar raised object. While it cannot be clearly told from U.S. Pat. No. Des. 213,546, issued Mar. 18, 1969, what its author had in mind at the opening of its disclosed plastic drinking cup, there is nothing in his disclosure to suggest a deviation from conventional structure.

U.S. Pat. No. Des. 193,586, by Clara Virginia Eicholtz, issued Sept. 11, 1962, discloses for its container for dairy products a circumferential rim which juts out radially around the region of the container cup opening. In practice, such a jutting rim portion would be even more detrimental than the rolled or rounded lips of the paint shield of the above mentioned Swiss Pat. No. 563 251 and of the drinking cup references. In particular, such a jutting portion would obstruct the paint brush or spray paint against reaching the entire surface to be painted, such as, the surface of the door immediately adjoining the shielded door knob cover plate or similar raised object. However, removing that rim portion would be contraindicated by that reference inasmuch as for the bevel in that prior art container to perform its intended function, i.e. as anchor for a cover, it cannot extend in a continuous transistion from the outer cylindrical surface to the opening. Rather, it must protrude so that the cover can lock onto it and a removal thereof would destroy usefulness of that prior art structure for its intended purpose. The same applies to articles designed as drinking cups which, as already pointed out in U.S. Pat. No. 21,955, by Louis Grosholz, issued Nov. 2, 1858, were and still are provided with a bead on the upper edge, which served and still serves the double purpose of imparting strength to the section, and affording a smooth edge for the lips of the drinker.

SUMMARY OF THE INVENTION

It is a general object of this invention to overcome the disadvantages and satisfy the needs expressed or implicit in the above disclosure statement or in other parts hereof.

It is a related object of this invention to provide improved painting systems.

It is a germane object of this invention to provide improved paint shielding systems.

It is also an object of this invention to provide improved methods and means for painting surfaces and structures on a selective basis.

It is a related object of this invention to provide improved methods of applying paint to a first surface surrounding a second surface or an object of specific geometrical shape.

It is also an object of this invention to provide improved devices for shielding a surface or object of specific geometrical shape during painting of a surrounding further surface.

It is a related object of this invention to provide improved apparatus for shielding raised circular objects during painting of surfaces surrounding such objects.

It is also an object of this invention to provide a circular paint shield that can readily be applied to, and safely retains itself on low-profile cover plates.

It is a related object of this invention to provide safer and more efficient methods and means for shielding raised circular objects of different diameters during painting of surfaces surrounding such objects.

It is a germane object of this invention to safeguard painters against injury from high-pressure spray paint.

Other objects of this invention will become apparent in the further course of this disclosure.

From one aspect thereof, the invention resides in a method of applying paint to any surface surrounding raised circular objects having different diameters, and, more specifically, resides in the improvement comprising in combination the steps of providing apart from said objects a self-supporting paint shield having at an end thereof an opening for receiving such objects; that opening being provided by an annular elastic lip tapering toward that opening for accommodating any of the objects, which are shielded with the subject paint shield by pushing the annular elastic lip onto any of the raised objects thereby expanding that annular elastic lip at said opening in diameter to any of the different diameters and exerting with that pushed elastic lip a gripping action supporting the paint shield on any of the objects. Paint may then be applied to the surface adjacent the latter object and exclusive of the latter shielded object, and the annular lip is elastically returned to an initial diameter at said opening upon removal of the paint shield from any of the objects.

From a related aspect thereof the subject invention resides in a device for shielding raised circular objects having different diameters, while painting any adjacent surface, comprising, in combination, a paint shield having a circular outer surface and being self-supporting apart from said objects and having at an end thereof an opening for receiving these objects; that paint shield having an annular elastic lip tapering toward said opening for accommodating any of the objects by expanding at said opening in diameter to any of said different diameters and exerting with that expanded elastic lip a gripping action supporting the paint shield on any of the objects, and for elastically returning to an initial diameter at said opening upon removal of the paint shield from any of the objects, and the annular lip has a circumferential bevel extending in a continuous transition from the circular outer surface to said opening for receiving the raised objects.

From a related aspect thereof, the invention resides in a method of applying paint to a surface surrounding a raised object, and, more specifically, resides in the improvement comprising in combination the steps of providing apart from that object a self-supporting paint shield having at an end thereof an opening for receiving that object; that opening being provided by a continuously annular wall portion of the paint shield having a continuously annular lip tapering toward the opening for forming around that opening a tapering brim portion and having across that opening a diameter smaller than a diameter of the circular object; the annular lip being made elastically deformable to permit enlargement of said smaller diameter for adaptation of the annular lip to the object and being adapted to extend to the surface while in contact with the raised circular object at said end. The object is shielded with the paint shield by twisting the annular wall portion onto the raised object and advancing the tapering brim portion toward the surface thereby expanding the elastically deformable lip in diameter to the raised object and exerting with the continuously annular wall portion a gripping action supporting the paint shield on the raised object, and paint is applied to the surface around the shielded object.

From a related aspect thereof, the invention resides in a device for shielding a raised circular object surrounded by a surface to be painted, comprising, in combination, a paint shield having a circular outer surface and being self-supporting apart from the object and having at an end thereof a continuously annular wall portion defining an opening for receiving that object; the annular wall portion comprising a continuously annular elastic lip having around said opening a tapering brim portion and having across said opening a diameter smaller than a diameter of the circular object, and the annular wall portion being expandable in diameter to the raised object and being adapted to extend with the tapering brim portion toward said surface while in contact with the raised circular object at said end, whereby to exert a gripping action supporting the paint shield on the object, and the elastic lip has a circumferential bevel extending as said brim portion in a continuous transition from said circular outer surface to the opening of the wall portion for receiving the raised object.

From a related aspect thereof, the invention resides in a device for shielding a raised circular object surrounded by a surface to be painted, comprising, in combination, a paint shield having a circular body with a circular outer surface, being self-supporting apart from said object, and having a continuously annular lip at an end thereof; said annular lip defining an opening having a diameter smaller than a diameter of the circular object; said annular lip having a bevel extending in a continuous transition from said circular outer surface of the cylindrical body to, and having a tapering brim at, a free end of said annular lip; and said annular lip being elastically deformable for enlargement of said smaller diameter and adaptation of said annular lip to said object in self-supporting gripping action therewith at said surface.

From a related aspect thereof, the invention resides in a method of applying paint to a surface surrounding a raised circular object, and, more specifically, resides in the improvement comprising in combination the steps of providing apart from the object a self-supporting paint shield, providing that self-supporting shield with a hollow-cylindrical wall portion extending about the raised circular object at right angles to the surface, providing the hollow-cylindrical wall portion with a uniform diameter corresponding to a diameter of the raised circular object so that the hollow-cylindrical wall portion is gripping the raised object whereby the shield is set with the hollow-cylindrical wall portion onto the raised object for self-supporting retention thereon, providing said wall with a bevel extending to said surface when the shield with the wall is set onto the raised object, and applying paint to said surface while shielding the object with the set shield.

From a related aspect thereof, the invention resides in a method of applying paint to a surface surrounding a raised circular object, and, more specifically, resides in the improvement comprising in combination the steps of providing apart from said object a self-supporting paint shield, providing that self-supporting shield with a cylindrical wall portion extending about the raised circular object at right angles to said surface, providing that cylindrical wall portion with a uniform diameter corresponding to the diameter of the raised circular object so that the cylindrical wall portion is gripping the raised object whereby the shield is set with the cylindrical wall portion onto the raised object for self-supporting retention thereon, providing the wall portion with a bevel extending to said surface when the shield with the wall portion is set onto the raised object, and applying paint to said surface while shielding the object with the set shield.

From a related aspect thereof, the invention resides in a method of applying paint to a surface surrounding a raised circular object, and, more specifically resides in the improvement comprising in combination the steps of providing apart from the object a self-supporting paint shield, providing that self-supporting shield with a cylindrical wall portion adaptable in diameter to the raised circular object, providing the paint shield with a circumferential bevel extending in a continuous transition from an outer surface of the cylindrical wall portion to a circular opening of the wall portion adapted to be placed adjacent the surface surrounding the raised object, gripping the raised object with the wall portion adaptable in said diameter whereby said shield is set with the wall portion onto the raised object for self-supporting retention thereon, and applying paint to said surface while shielding the object with the set shield.

From a related aspect thereof, the invention resides in a device for shielding a raised circular object during painting of a surface surrounding said raised object, comprising a paint shield being self-supporting apart from that object and having a cylindrical wall portion adapted to extend when set on the object to said surface at right angles thereto and having a uniform diameter corresponding to the diameter of the raised circular object so that the cylindrical wall portion is adapted to grip the raised object whereby the shield is settable with the wall portion onto the raised object for self-supporting retention thereon; said paint shield having a circumferential bevel extending in a continuous transition from a cylindrical outer surface of the hollow-cylindrical wall portion to a circular opening of the wall portion adapted to be placed adjacent the surface surrounding said raised object.

Other aspects of the invention will become apparent in in the further course of this disclosure, and no limitation whatever is intended by this summary of the invention in any respect.

BRIEF DESCRIPTION OF THE DRAWINGS

The subject invention and its various aspects and objects will become more readily apparent from the following detailed description of preferred embodiments thereof, illustrated by way of example in the accompanying drawings, in which like reference numerals designate like or functionally equivalent parts, and in which:

FIG. 4 is a view similar to FIG. 1 showing a tapered paint shield and its application to a door knob cover plate according to a preferred embodiment of the subject invention;

FIG. 5 is a detail view similar to FIG. 3, on a further enlarged scale, of part of a paint shield according to a preferred embodiment of the subject invention;

FIG. 6 is a view, on a reduced scale, taken on the line 6—6 in FIG. 5 and on an extension of that line;

FIG. 7 is a detail view similar to FIG. 3, on a further enlarged scale, of part of a paint shield according to a modified embodiment of the subject invention;

DESCRIPTION OF PREFERRED EMBODIMENTS

Figure 1:
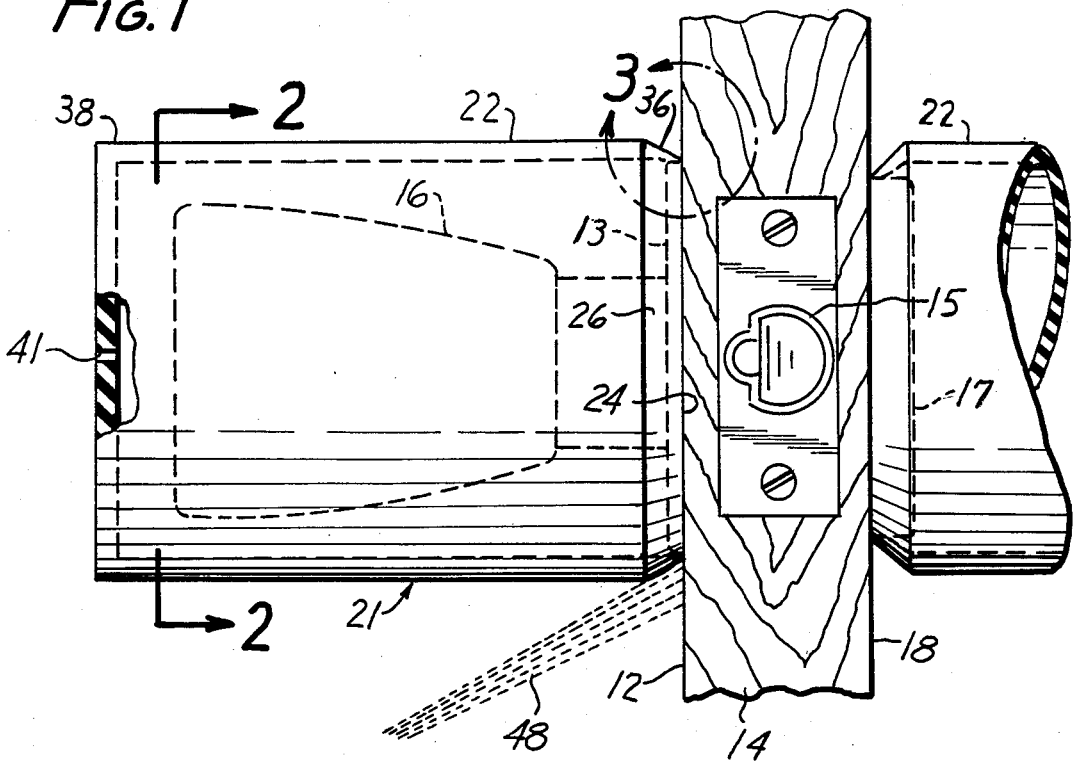
FIG. 1 is a side view of a portion of a door and of a paint shield according to a preferred embodiment of the subject invention.

The accompanying drawings, by way of example, show assemblies for facilitating painting of a surface 12 surrounding a raised circular object 13 which may be mounted on or affixed to the surface 12. In the drawings, the surface 12 to be painted is a surface of a door 14 having a lock or latch mechanism 15 actuated by a door handle or knob 16 having the raised object 13 as a cover plate or element on the surface 12. In practice, what has been termed herein as "raised object" may in fact be just the latter element, sometimes called "rosette" or "rose," or the larger door knob structure 16 or a significant part thereof.

Another example of a raised mounted object is shown in FIG. 1 in the form of a cover plate or element 17 of a key-operated door lock. The paint shields of the subject invention may also be employed to shield raised objects of the type of lock portion 17, or may be manufactured for, or adapted to shielding other kinds of raised objects surrounded by surfaces 18 to be painted.

In this respect, the accompanying drawings show low-profile cover plates 13 having a height at the circular rim on the order of one-eighth of an inch or three millimeters. It is a special feature of the illustrated and herein disclosed preferred embodiments of the subject invention that their paint shields can be applied to, and will self-supportingly be retained on, such low-profile cover plates or objects, while being also suitable for shielding of, and self-supporting retention on, cover plates having a height on the order of one-quarter of an inch or six millimeters, or similarly dimensioned objects.

According to the illustrated preferred embodiments of the subject invention, the devices 21 shown therein comprise an inherently self-supporting paint shield 22 or 23; that is the paint shield, unlike masking tape, is self-supporting apart from the object being masked or shielded.

The self-supporting paint shield 22 or 23 has at an end 24 or 25 thereof an annular wall portion 26 or 27 defining an opening 28 for receiving the raised object 13 or 17. Unlike wound masking tape and wound or spiral paint shields, and unlike other paint shields having some discontinuity, such as those shown in the above mentioned Kahn U.S. Pat. No. 2,925,064, Farrell U.S. Pat. No. 3,722,470 and Harrington U.S. Pat. No. 4,195,590, the wall portion 26 or 27 is continuous and is thus referred to as a "continuously annular wall portion."

The continuously annular wall portion 26 has around the opening 28 a tapered or tapering brim portion 31 or 32.

Figure 2:
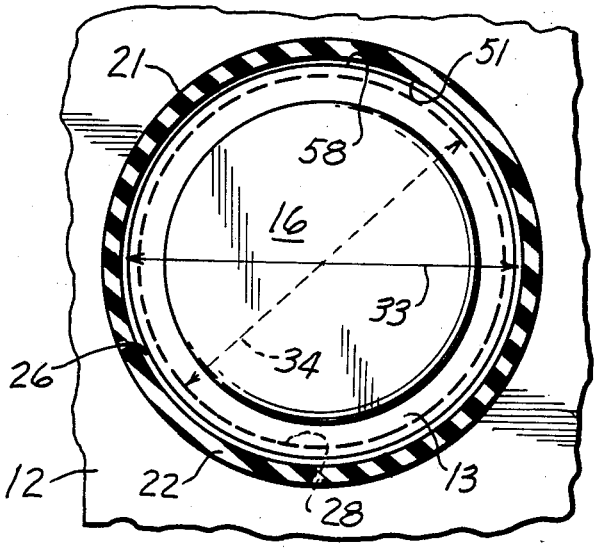
FIG. 2 is a view taken on the line 2—2 in FIG. 1.

In the relaxed or rest position of the paint shield 22 or 23, that is, before such paint shield is placed onto an object 13 or 17, the continuously annular wall portion 26 or 27 has a diameter different from a diameter 33 of the circular object 13. As shown in FIG. 2 in dotted lines, the continuously annular wall portion 26 has across its opening 28 a diameter 34 smaller than the diameter 33 of the circular object and is adapted to expand in diameter when twisted onto such circular object 33. In more general terms, the annular wall portion 26 or 27 is adaptable in diameter to the raised object 13 or 17 and is adapted to extend with its tapering brim 31 or 32 to the surface 12, while in contact with the raised circular object 13 or 17 at the end 24 or 25 of the shield 22 or 23, whereby to exert a gripping action supporting the paint shield on the raised object.

The annular wall portion 26 or 27 has a bevel 36 or 37 extending as, or as part of, the tapering brim 31 or 32 in a continuous transition to the paint shield end 24 or 25. In the illustrated embodiments, the bevel 36 or 37 defines or delimits the tapering brim portion 31 or 32. The paint shield 22 or 23 has a body 38 or 39 for enclosing the object 13, 16 or 17 behind the opening 28, as seen from such opening.

In the illustrated preferred embodiments, the paint shield has a circular body 38 or 39 for supporting the annular wall portion 26 or 27 apart from the raised object, when the paint shield is removed from such object 13 or 17. As seen in the drawing, the tapering brim portion 31 or 32 or annular lip 46 or 47 has or is provided with an inner wall surface 62 projecting at an angle to the circular body 38 or 39 from a diameter of the circular body larger than the above mentioned smaller diameter 34 (FIG. 2) to that smaller diameter 34 at, of or across the opening 28 for receiving the object 13 or 17. When the paint shield has been set on the object to be shielded, then such raised object 13 or 17 supports the paint shield body 38 or 39 via the annular wall portion 26 or 27 of the shield 22 or 23.

Figure 3:
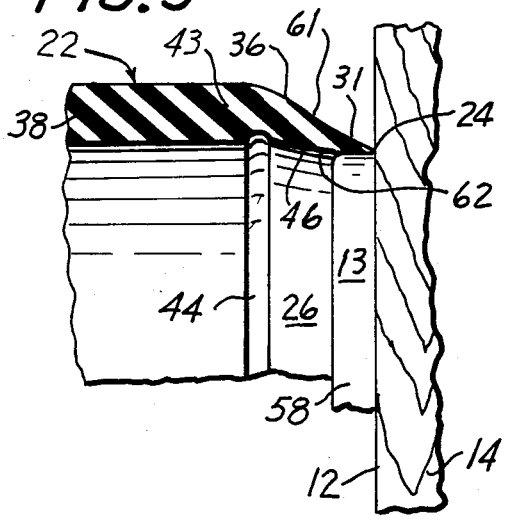
FIG. 3 is a detail view on an enlarged scale taken approximately within the circular outline 3 in FIG. 1.

According to a preferred embodiment shown in FIG. 1, the paint shield body 38 has an air escape hole 41 therethrough. This, in practice, helps the setting of the paint shield on the raised object. A similar air escape hole (not shown) may be used in the paint shield 23 of FIG. 4. As seen in FIG. 3, the paint shield 22 has a circular hinge 43 between the body 38 and the annular wall portion 26. By way of example, the circular or annular hinge 43 is formed by providing a circular indentation 44 inside of the paint shield 22. The same kind of indentation and circular hinge (not shown) may be employed in the paint shield 23 of FIG. 4.

As seen particularly in FIGS. 3 and 4, the annular wall portion 26 or 27 preferably is a continuously annular elastic lip 46 or 47 of the body 38 or 39 defining the opening 28 for receiving the raised circular object 13 or 17. In principle, the circular identation 44 may extend around and be located at the outside of the paint shield 22 or 23, as long as it does not interfere with the painting action or accumulate an undue amount of paint.

In the illustrated preferred embodiments of the subject invention, the paint shield 22 or 23 has a circular body 38 or 39 with a circular outer surface, being self-supporting apart from the object 13 or 17, and having a continuously annular lip at an end 24 or 25 thereof; such annular lip 46 or 47 defining an opening 28 having a diameter 34 smaller than a diameter 33 of the circular object, as shown in FIG. 2.

The annular lip 46 or 47 has a bevel 36 or 37 extending in a continuous transition from the circular outer surface of the circular body 38 or 39 to, and having a tapering brim 31 or 32 at, a free end 24 or 25 of the annular lip.

As seen in FIGS. 2 to 4, the annular lip 46 or 47 is elastically deformable for enlargement of the smaller diameter 34 and adaptation of the annular lip to the object 13 or 17 in self-supporting gripping action therewith at the surface 12 to be and being painted. An annular hinge 43 is preferably provided at the circular body 38 or 39 for connecting the annular lip 46 or 47 to such circular body.

The paint shield 22 according to FIGS. 1 to 3 has a hollow-cylindrical body 38. On the other hand, the paint shield 23 shown in FIG. 4 has a tapered or frustoconical body 38 which, under some circumstances, may be easier or more convenient to handle and which permits a stacking of several paint shields upon each other.

The subject invention also provides methods of applying paint to a surface 12 or 18 surrounding a raised circular object 13 or 17.

According to a preferred embodiment thereof, the invention resides in the improvement comprising, in combination, the steps of providing apart from the object 13 or 17 a self-supporting paint shield 22 or 23 having at an end 24 or 25 thereof an opening 28 for receiving the object, such opening being provided by a continuously annular wall portion 26 or 27 of the paint shield having around the opening 28 a tapering brim and having across such opening a diameter 34 smaller than a diameter 33 of the circular object and being adapted to extend to the surface 12 or 18 while in contact with the raised circular object 13 or 17 at the end 24 or 25.

According to this preferred method of the invention, the object 13 or 17 is shielded with the paint shield 22 or 23 by twisting such paint shield at the annular wall portion 26 or 27 onto the raised object and advancing the tapering brim 31 or 32 to the surface 12 or 18, thereby adapting the annular wall portion in diameter to the raised object and exerting with the continuously annular wall portion 26 or 27 a gripping action supporting the paint shield 22 or 23 on the raised object 13 or 17. Paint 48 may then be applied to the surface 12 exclusive of the shielded object 13, 16 or 17. A spray paint gun (not shown) may be employed for applying the paint 48 to the object, but the shields of the subject invention may also be employed when, for instance, paint brushes or other implements are used to apply paint to the surface 12 exclusive of the raised object 13, 16 or 17.

According to the illustrated preferred embodiments of the subject invention, the object 13, 16 or 17 is shielded with the paint shield 22 or 23 by twisting such paint shield at its annular wall portion 26 or 27 onto the raised object 13 or 17 and advancing the tapering brim portion 31 or 32 to the surface 12 or 18 to be painted, thereby adapting the annular wall portion 26 or 27 in diameter to the raised object and exerting with such continuously annular wall portion a gripping action supporting the paint shield on the raised object on which it has been set. Paint 48 may thereupon be applied to the surface 12 or 18 exclusive of the shielded object 13, 16 or 17.

As shown with the aid of FIG. 2, the continuously annular wall portion 26 or 27 of the paint shield 22 or 23 is provided across its opening 28 with a diameter 34 smaller than the diameter 33 of the circular object 13 or 17 and is adapted to expand in diameter when twisted onto such circular object, whereby the initial opening 28 of the shield is expanded to an enlarged opening 51 corresponding to the perimeter of the raised circular object onto which the shield is set.

Upon removal of the shield from the raised object, the enlarged opening 51 elastically returns to the smaller initial opening 28. To this end, at least the annular wall portion 26 or 27 or annular lip 46 or 47 are made of elastic material, such as natural or synthetic rubber, an elastomer or other substance having elastic properties similar to rubber. In this respect, the body 38 or 39 of the paint shield may be made of the same elastic material as the annular wall portion 26 or 27 or annular lip 46 or 47.

Prototype work has confirmed that paint shields so made with at least an elastic lip may readily be applied to such objects as doorknob cover plates of different diameters by twisting the shield thereonto as, for instance, illustrated in FIG. 4 for both of the paint shields 22 and 23.

By way of example, the painter may pick up or engage a paint shield 22 or 23 with his or her thumb 53 and finger 54 and advance it at its opening 28 past the doorknob 16 to the cover plate 13. The paint shield 22 or 23 may thereby be held with its longitudinal axis at an angle to the longitudinal axis of the doorknob 16, or in such other manner that a part 56 of the annular wall portion 26 or 27 or lip 46 or 47 overlaps a corresponding part of the circumference of the cover plate 13. Unless the initial diameter 34 of the paint shield is close to the diameter 33 of the particular cover plate 13, another part 57 of the annular wall portion 26 or 27 or lip 46 or 47 will thereby be pinched at the cover plate 13, abutting against a surface thereof facing in a direction away from the surface 12 to be painted. In order to move the entire annular wall portion 26 or 27 or lip 46 or 47 onto the side or periphery 58 of the cover plate 13, the paint shield 22 or 23 is twisted as indicated by the arrow 59 in FIG. 4. In this respect, the verb "to twist" or its continuous form "twisting" may be broad enough to denote the dictionary meaning of "to move forward while turning," as far as the motion or movement of the shield to and over the object 13 or 17 is concerned and as indicated, for instance, by the arrow 59, having components both in the direction of the cover plate 13 and surface 12 and around or about the doorknob 16 and cover plate 13.

In this or any equivalent manner, the annular wall portion 26 or 27 or lip 46 or 47 will spring or be wound, so to speak, onto the cover plate 13 at its circumference 58, until the entire wall portion or lip sits on that circumference, exerting a gripping action on the cover plate 13, thereby retaining the shield 22 or 23 in its shielding position at the surface to be painted.

In accordance with a preferred embodiment of the invention, the annular hinge 43 and internal circular groove 44, as shown by way of example in FIG. 3, provide the annular wall portion 26 or 27 or lip 46 or 47 with an elastic flexibility relative to the paint shield body 38 and 39.

One of the outstanding qualities of the paint shield according to the subject invention is that it may be adapted to circular objects of various diameters and heights. While not limited to any particular application, doorknob cover plates of different diameters, heights and makes may thus be accommodated with one and the same paint shield. For instance, as shown at the right-hand side of FIG. 1, the paint shield 22 may also be employed to shield a raised circular object 17 of a diameter and height different from those of the circular object 13.

The above mentioned features of the illustrated embodiments of the invention, including the provision of the bevel 36 or 37, of the paint shield body 38 or 39, of the air escape hole 41, of the annular hinge 43, of the internal circular groove 44 and/or of the elastic lip 46 or 47, may, for instance, be effected by injection molding or any other appropriate methods.

Most advantageously, the paint shield 22 or 23 may be molded in one piece, including the body 38 or 39 and annular wall portion 26 or 27 with lip 46 or 47.

In principle, the initial opening of the paint shield could be made larger in diameter than the raised circular object 13 or 17, and could then be reduced in diameter to that of the object to be shielded, such as by means of a resilient band, adjustable clip or other tensioning means of the type shown or disclosed in the above mentioned parent application Ser. No. 06/495,300.

Within the broad scope thereof, the subject invention thus resides in a method of applying paint to a surface 12 or 18 surrounding a raised circular object 13 or 17 and, more specifically, provides apart from such object a self-supporting paint shield having at an end thereof an opening for receiving such object. According to the invention, that opening is provided by a continuously annular wall portion of the paint shield having across such opening a diameter different from a diameter 33 of the circular object and being adapted to extend to the surface 12 or 18 while in contact with the raised circular object at the end 24 or 25. Also according to the invention, the object is shielded with the paint shield by pushing the annular wall portion onto the raised object 13 or 17 to the surface 12 or 18, thereby adapting the annular wall portion in diameter to the raised object and exerting with the pushed annular wall portion a gripping action supporting the paint shield on the raised object. Paint 48 may then be applied to the surface 12 or 18 exclusive of the shielded object.

In structural terms, the invention resides in a device for shielding a surface surrounding a raised circular object 13 or 17 and, more specifically, resides in a combination comprising a paint shield being self-supporting apart from the object and having at an end 24 or 25 thereof a continuously annular wall portion defining an opening for receiving the object, such annular wall portion having across its opening a diameter different from a diameter 33 of the circular object. Also according to the invention, the annular wall portion is adaptable in diameter to the raised object 13 or 17 and is adapted to extend to the surface 12 or 18 while in contact with such raised circular object at the end 24 or 25, whereby to exert a gripping action supporting the paint shield on the raised object.

As seen in the drawings, including FIGS. 3, 5 and 7, the paint shield 22 or 23 or the annular wall portion 26 or 27 has a circumferential outer wall portion 61 and a corresponding inner wall portion 62 converging toward each other from the paint shield body 38 or 39 toward the paint shield end 24 or 25 or toward the opening 28. The converging wall portions 61 and 62 thus delimit or define the tapering brim portion 31 or 32 or the elastic annular lip 46 or 47 tapering toward the end 24 or 25 or opening 28. In this manner, the annular wall portion 26 or 27 may be formed as a continuously annular elastic lip 46 or 47 tapering toward the shield opening 28 for forming the tapering brim portion 31 or 32.

According to an embodiment of the subject invention, the tapering brim portion 31 or 32 is provided or preformed with a dull annular edge around the shield opening 28.

For example, and as shown in FIGS. 5 to 7, the tapering brim portion may be provided or preformed with a flat annular edge 64 or 65 around the opening 28. As shown in FIGS. 5 and 6, the tapering portion is provided with a flat annular edge 64 extending radially of the continuously annular wall portion. As may be seen in FIG. 5, the flat annular edge 64 extends in a radial plane adjacent the continuously annular wall portion. The teachings of FIGS. 5 to 7 may be applied to both the brim portions 31 and 32 and to both the annular wall portions 26 and 27 even though only the brim portion 31 is shown by reference numeral in FIGS. 5 to 7.

According to the embodiment shown in FIG. 7, the tapering brim portion 31 is provided with a hollow-cylindrical edge 65 extending around the opening 28. Since the annual lip 46 or 47 or brim portion is elastic, the flat annulus 65 may not be cylindrical in the relaxed condition of the shield, but is made to be cylindrical when the shield is set onto the object 13, as seen in FIG. 7, or in FIGS. 3 and 5 for that matter.

Because of the dullness or flatness of the rim of the illustrated embodiment, damage to the rim portion during repeated settings of the shield on raised objects is minimized. Also, the elastic lip or rim portion is thicker and stronger at the edge of the opening 28 when the brim portion is dull or flat at such edge, than if it were razor-sharp. Accordingly, shields according to preferred embodiments of the subject invention are particularly well suited to accommodate themselves to raised objects 12, 17, etc., of various diameters, thicknesses or other dimensions, and are very robust and suitable for repeated use, displaying great retentivity and stability on various raised objects.

A preferred range for the width of the annular flatnesses 64 and 65 is from 0.2 to 0.5 mm. For instance, the tapering brim portions 31 may be provided with a flat annular edge 64 extending radially from the opening 28 for from 0.2 to 0.5 mm. Similarly, the tapering brim portion 31 may be provided with a hollow-cylindrical edge 65 having a width of from 0.2 to 0.5 mm and extending around the opening 28. In this manner, occurrence of a clearly visible unpainted ring or halo around the object 13 is avoided.

Alternatively or additionally, and as illustrated in FIG. 5, a method according to a further embodiment of the subject invention includes the step of spacing the paint shield 22 or 23 or brim 31 on the raised object 13 from the surface 12 to be painted circumferentially around the raised object by a distance equal to a predetermined thickness $\Delta$ of paint 48 applied to the surface 12 around the shielded object 13.

FIG. 5 of the accompanying drawings shows a method that may be used with any of the embodiments herein disclosed. That embodiment of the invention resides in a method of applying paint up to a predetermined paint thickness $\Delta$ to a surface 12 surrounding a raised circular object 13, and includes the improvement comprising in combination the steps of providing apart from the object 13 a self-supporting paint shield 22, providing that self-supporting shield with a cylindrical wall portion at opening 28 adapted to extend about the raised circular object at right angles to the surface 12, and providing the cylindrical wall portion with a wall thickness d corresponding to the paint thickness Δ and with a uniform diameter corresponding to the diameter of said raised circular object 13 so that the cylindrical wall portion is gripping the raised object when the shield 22 is set with its mentioned wall portion onto the raised object for self-supporting retention thereon.

Prior to an application of paint 48 to the surface 12, the setting of the paint shield 22 preferably includes spacing the paint shield 22 on the raised object 13 from the surface 12 circumferentially around the raised object 13 by a distance equal to the paint thickness Δ; that is, equal to the thickness of the paint 48 to be applied to the surface 12 around the shielded object 13. In this manner, an unpainted halo around the raised object is effectively avoided.

In practice, the spacing Δ may, for instance, be realized by first twisting or pushing the shield 38 or 39 on the object to the surface 12 and by then withdrawing such shield 38 or 39 on that object 13 by the distance Δ.

The currently discussed aspect of the invention thus resides in a device for shielding a raised circular object 13 during application of paint 48 up to a predetermined paint thickness Δ to a surface 12 surrounding that object, comprising a paint shield being self-supporting apart from that object and including when set on that object a hollow-cylindrical wall portion adapted to extend about the raised object 13 to the surface 12 at right angles thereto, having a wall thickness d corresponding to the paint thickness and having when set on the object 13 a uniform diameter 33 corresponding to the diameter of the raised circular object so that the hollow-cylindrical wall portion is adapted to grip said raised object uniformly around the circumference of said raised object as shown in FIG. 5, whereby the shield is settable with its hollow-cylindrical wall portion onto the raised object for self-supporting retention thereon, and seals that object against penetration by wet paint.

The following methods, apparatus and features may also be employed in implementing the embodiments herein disclosed.

For example, in a method of applying paint 48 to a surface 12 surrounding a raised circular object 13, there may be provided apart from that object a self-supporting paint shield 22 or 23 provided with, or having when set on that object, a cylindrical wall portion extending about that raised circular object at right angles to the surface 12, as seen, for example, at 65 in FIG. 7 or at the object 13 in FIGS. 3 and 5, or as shown in the drawings of the latter parent application. That cylindrical wall portion is provided with a uniform diameter 33 corresponding to the diameter of the raised circular object so that the cylindrical wall portion is gripping the raised object whereby or when the shield 22 or 23 is set with that cylindrical wall portion onto the raised object 13 for self-supporting retention thereon, and paint is applied to the surface 12 while shielding the object 13 with the set shield 22 or 23. The shield 22 or 23 is thus settable with the mentioned wall portion onto the raised object 13 or 17 for retention thereon. The wall portion just mentioned preferably is provided with a circumferential bevel 36 or 37 extending to the surface 12 when the shield 22 or 23 or its wall portion is set onto the raised object. Where the paint shield or its wall portion defines a circular opening 28, that wall portion preferably has a bevel 36 or 37 extending to that opening.

According to an embodiment of the invention, the self-supporting shield 22 or 23 is provided with a cylindrical wall portion adaptable in diameter to the raised circular object.

The latter paint shield has a circumferential bevel 36 or 37 extending in a continuous transition from an outer surface of the cylindrical wall portion to a circular opening of the wall portion adapted to be placed adjacent the surface 12 surrounding the raised object 13. That raised object is gripped with the wall portion corresponding thereto in diameter whereby the shield is set with its wall portion onto the raised object 13 for self-supporting retention thereon, and paint may be applied to the surface 12 while shielding the object 13 with the set shield. In this respect, the cylindrical wall portion preferably is provided with a uniform diameter for a gripping of the raised circular object 13 uniformly around the circumference of that circular object.

My invention thus provides a paint shield being self-supporting apart from the object 13 and having a cylindrical wall portion adapted to extend when set on that object to the surface 13 at right angles thereto and having a uniform diameter 33 corresponding to the diameter of the raised circular object so that the cylindrical wall portion is adapted to grip the raised object uniformly around the circumference of that raised object whereby the shield is settable with its wall portion onto the raised object for self-supporting retention thereon. That paint shield preferably has a circumferential bevel 36 or 37 extending in a cylindrical outer surface of the hollow-cylindrical wall portion to a circular opening 28 of that wall portion adapted to be placed adjacent the surface 12 surrounding the raised object 13. The paint shield preferably has or is provided with a taper, as seen, for example, at 23 and 39 in FIG. 4, extending in a direction away from the bevel 36 or 37.

Further embodiments within the scope of my invention are shown in FIGS. 8 to 15. These embodiments also comprise an inherently self-supporting paint shield 21 or 115 having a wall 117 or 118 extending about the object 13 while paint 48 is being applied to the surface 12.

Figure 8:
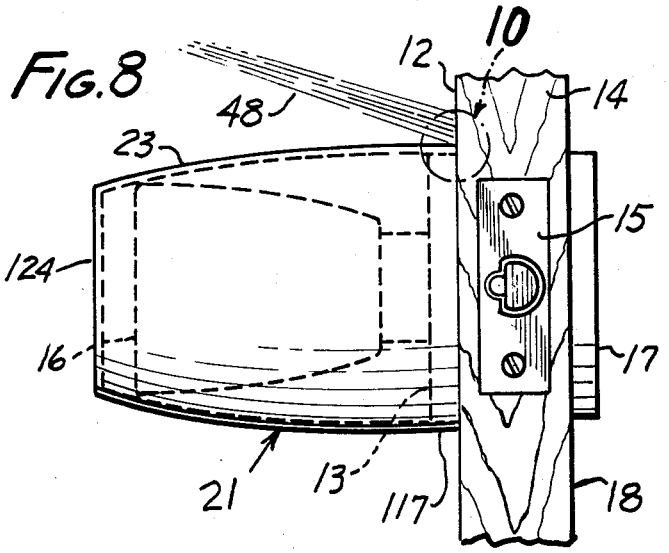
FIG. 8 is a side view of a portion of a door and of a paint shield according to an embodiment of the subject invention.
Figure 9:
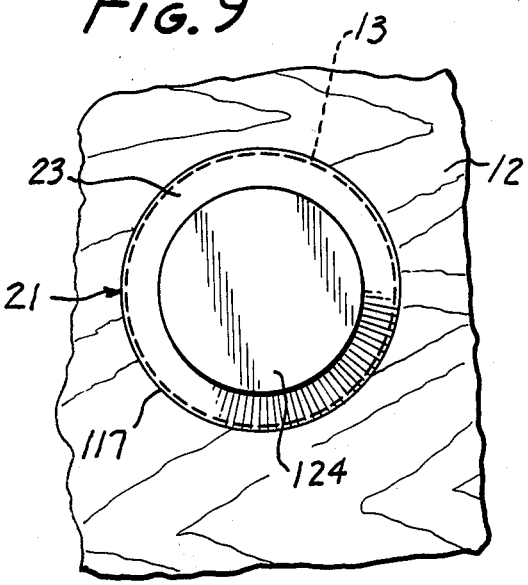
FIG. 9 is a view from the left-hand side of the assembly shown in FIG. 8.
Figure 12:
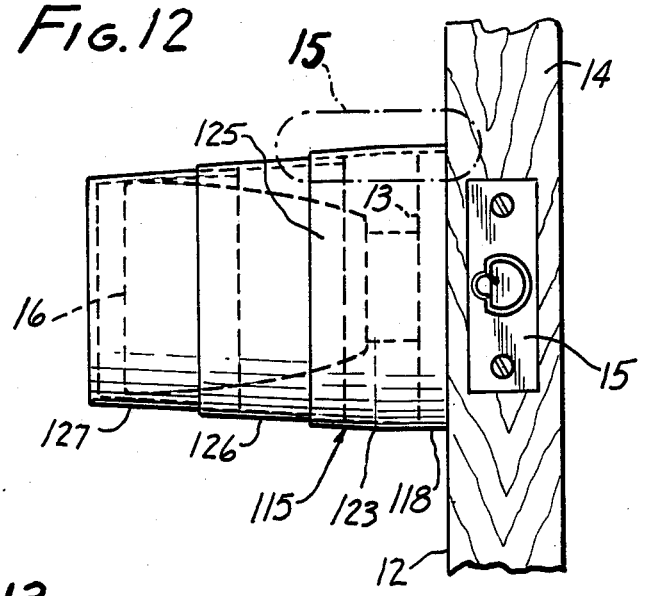
FIG. 12 is a side view, being similar to the view of FIG. 8 and showing a paint shield or assembly according to a further embodiment of the subject invention.

As seen, for instance, in FIGS. 8 and 12, the wall 117 or 118 extends or is positioned at an angle to the surface 12. This angle preferably is a right angle, at least in the vicinity of surface 12 or object 13.

Figure 10:
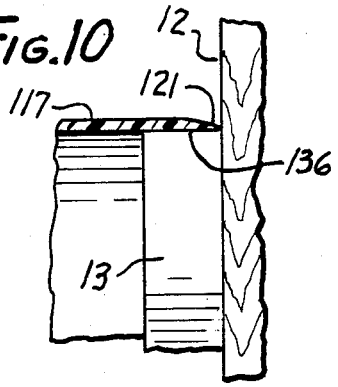
FIG. 10 is a detail view taken approximately within the circular outline 10 in FIG. 8, on an enlarged scale.
Figure 15:
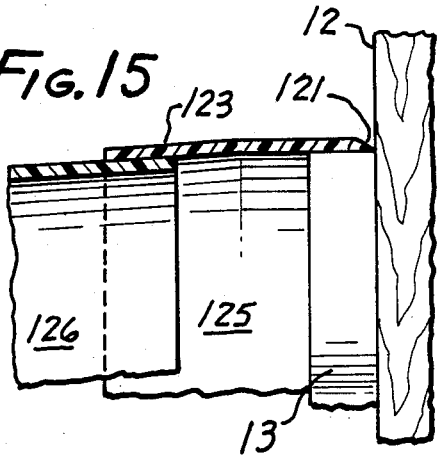
FIG. 15 is a detail view approximately within the outline 15 of FIG. 12, on an enlarged scale.

According to a preferred embodiment of the subject invention, illustrated particularly in FIGS. 10 and 15, the wall 117 or 118 has a taper 121 extending to the surface 12 and sealing around the raised object 13. The taper 121 represents an important feature of the latter embodiments which permits the paint 48 to cover the surface 12 in extreme proximity to the raised object 13 without, however, leaving marks or dabs on that shielded object.

According to the latter illustrated embodiments of the invention, the wall 117 or 118 also has a hollow-cylindrical portion extending to the surface 12 at right angles thereto, as seen particularly well in FIGS. 10 and 15. This also is an important feature of these embodiments, since it permits the paint shields to grip the raised object 13 most effectively for self-supporting, but manually releasable retention thereon, in proximity to the surface 12 being painted.

The feature of a hollow-cylindrical front portion of the paint shield walls 117 and 118 is advantageously combined with the feature of a circumferential outer taper or bevel 121 for optimum shielding of the object 13 coupled with maximized coverage of the surface 12. The hollow-cylindrical configuration of the paint shield or paint shield wall front portion synergistically combines effect with that of the circumferential bevel 121, inasmuch as a shield which extends over a raised object 13 at right angles or perpendicularly to the surface to be painted projects itself to a far lesser extent onto such surface 12 than a shield which would extend at an obtuse angle to such surface. In this respect as in the other illustrated embodiments the bevel extends in a continuous or smooth transition from a cylindrical outer surface of the wall portion to a circular opening of the wall portion (see, for instance, openings 28 and 136) adapted to be placed adjacent the surface 12 surrounding the raised object 13. This is just the opposite of Eicholtz who requires a laterally projecting rim for retaining a lid on her dairy products container and of Farrell who relies on the thinness of the material out of which his shields are made to obtain full and clean paint coverage.

By way of example, and not by way of limitation, the assemblies shown in FIGS. 8 to 15 of the drawings are adapted to facilitate painting of a surface surrounding a raised circular object. According to these embodiments, the inherently self-supporting paint shield has a circular wall corresponding in diameter to, and extending about, the raised circular object 13 for shielding such object during painting of the surface 12. The circular wall 117 or 118 preferably extends or is made to extend around the raised circular object, and preferably grips the raised circular object circumferentially.

According to an embodiment of the subject invention, the paint shield, in addition to the bevel or taper 36, 37 or 121 extending to the surface 12 and surrounding the raised object 13, may have a second taper 23 extending in a direction away from the bevel or first taper, as seen in FIGS. 4, 8 and 12.

The self-supporting paint shield also may have a closed bottom 124 covering the raised object 13 or 16.

Figure 13:
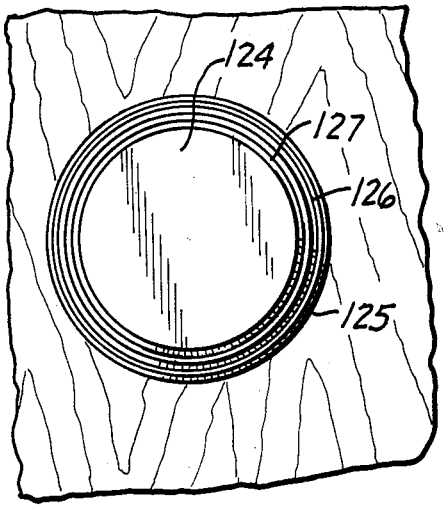
FIG. 13 is a view from the left-hand side of FIG. 12 of the equipment shown therein.

According to the embodiment of the invention shown in FIGS. 12 to 15, the paint shield 115 is composed of nested paint shield elements 125, 126 and 127 extending about the raised object 13 for shielding that object during painting of the surface 12. Where the raised object 13 is circular, the nested paint shield elements 125 to 127 may also be circular, as seen in FIG. 13.

An outer one of the elements 125 to 127, namely the element 125, has the previously disclosed bevel 121 extending to the surface 12 and surrounding the raised object 13. As seen in FIG. 15, it is this outer element 125 which circumferentially grips the raised object 13. Most advantageously, the bevel 121 extending to the surface 12 and surrounding the raised object 13 may be provided on the hollow-cylindrical front portion of the outer paint shield element 125, as shown in FIG. 15.

The innermost element 127 of the nested paint shield elements has a closed bottom 124 covering the raised object.

The paint shields of the subject invention may also be employed to shield raised objects of the type of lock portion 17, or may be manufactured for, or adapted to, shielding other kinds of raised objects surrounded by surfaces to be painted.

The subject invention also resides in methods of applying paint to a surface 12 surrounding a raised object 13 of specific or circular geometrical shape. According to this aspect of the invention, these methods comprise the steps of providing apart from the object 13 a self-supporting paint shield, and of providing such self-supporting shield with a wall 117 or 118 extending about the particular geometrical shape. In the case of a circular raised object 13, the self-supporting shield is provided with a circular wall 117 or 118 corresponding in diameter to the raised circular object 13. The shield is then set with the wall 117 or 118 onto the raised object 13, and paint is applied to the surface 12 while shielding the raised object with the set shield.

The disclosed method step of providing apart from the object 13 and surface 12 a self-supporting paint shield distinguishes itself favorably from the most widely employed prior-art method of providing a masking tape which is typically supplied on a roll but is not inherently self-supporting. Rather, the masking tape, when pulled from the roll, is practically limp and has to be skillfully installed by the painter on and around the raised object 13. Frequently, the requisite skill and precision are lacking or cannot be exerted under specific practical circumstances. In consequence, painting jobs of the type herein considered, when executed with masking tape or similar auxiliary means, frequently lack the desired quality and neatness.

The subject invention effectively counters these drawbacks by providing the paint shield as self-supporting apart from the object 13 or the surfaces to be painted and to be shielded, respectively.

The paint shields according to the illustrated preferred embodiments of the invention are solid geometry paint shields having, for instance, a hollow-cylindrical overall configuration as shown in FIGS. 1 to 3, an essentially cylindrical or conical configuration as shown in FIGS. 8 to 11, or an overall frusto-conical configuration as shown in FIG. 12. According to the illustrated embodiments, the outer wall of the paint shields may be provided as a closed wall, as in the case of wall 117 shown in FIGS. 4 to 11, or as in the case of shield elements 125 to 127 shown in FIGS. 12 to 15.

Figure 11:
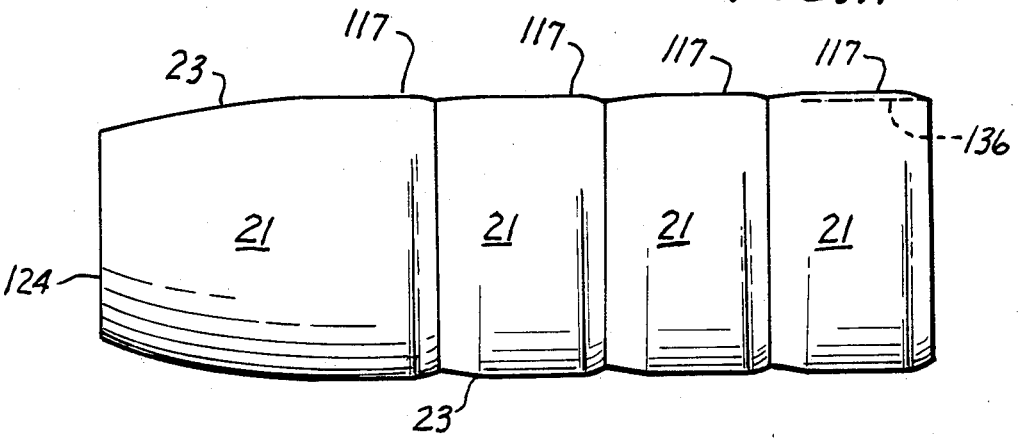
FIG. 11 is a side view of apparatus for shielding raised circular objects according to an embodiment of the invention.

FIG. 11 is illustrative of a combination according to an embodiment of the invention, useful in methods of applying paint to surfaces surrounding raised objects. In particular, there are provided self-supporting paint shields 21 corresponding or being expandable in diameter to any diameter of circular objects 13 or 17. The paint shields are provided with a taper 23 and such tapered paint shields are stacked onto each other at their tapers as shown FIG. 11.

In practice, this provides considerable economy of space in storage and shipping of the paint shields and within the confines of the painter's tool or utility box.

The method under consideration also includes the steps of removing the stacked paint shields 21 from each other, setting such removed paint shields onto raised circular objects 13 to cover each of these objects at least laterally, and applying paint to the surfaces 12 exclusive of the covered objects 13. Each paint shield 21 is provided with an opening 136 for receiving one of the objects 13 and, in the embodiment of FIG. 11, for receiving another one of the tapered shields 21. The opening 136 of a shield is provided at a distance from its taper 23. On the other hand, the taper 121 is located at, or extends to, the shield opening 136 in the preferably hollow-cylindrical front portion of the shield.

In the case of circular objects 13, the paint shields 21 or their walls 117 are correspondingly circular.

FIG. 11 in effect represents an apparatus for shielding raised circular objects during painting of surfaces surrounding such objects. The apparatus according to this embodiment of the invention comprises self-supporting circular paint shields 21 corresponding, respectively in diameter, to the circular objects 13, and having a taper 123, and being releasably stacked onto each other, as seen in FIG. 11.

Each paint shield may be provided with a closed bottom 124 opposite its opening 136. In principle, the bottoms 124 could be omitted thereby leaving a rear opening in the paint shield opposite the front opening 136. This would still laterally shield the raised object, which may be sufficient in the case of brush painting or even narrow-angle spray painting. Provision of a closure or bottom 124 is, however, preferred where a complete enclosure of the shielded object is desirable or necessary.

Figure 14:
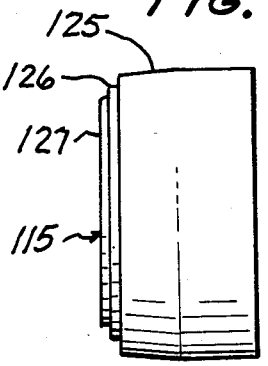
FIG. 14 is a side view of the paint shield shown in FIG. 12, in a collapsed condition.

Stacked paint shield structures and techniques are also apparent from FIGS. 12 to 15. In particular, the method illustrated in that embodiment of the invention composes a paint shield 115 of nested paint shield elements 125 to 127, making one of these elements, such as the outer elements 125, to extend about the geometrical shape of the raised element 13. This paint shield is stored in a collapsed position or condition wherein the elements 125 to 127 are located inside each other, as seen in FIG. 14. More precisely, a median element 126 is concentrically located inside the outer element 125, and innermost element 127 is concentrically located inside the median element 126. In practice, the collapsible shield 115 may be composed of only two of the stacked elements, or may be composed of more than three elements 125 to 127 in order to reduce the height of the collapsed shield.

As seen in FIG. 12 relative to FIG. 14, the paint shield 115 is extended to an expanded position wherein the elements 125 to 127 jointly form the wall structure surrounding and covering the raised object 13 or 17.

The extended paint shield 115 with its wall structure is set onto the raised object, and paint is applied to the surface 12 while shielding the object with the set shield 115.

The innermost of the nested elements is preferably provided with a closed bottom 124 to provide complete coverage of the shielded object. In a less expensive and lighter version, the bottom 124 may, however, be omitted from the innermost element 127, when an only lateral shielding of the raised object is sufficient in particular circumstances.

In practice, the paint shield 21 of FIGS. 8 to 11 may be manufactured with the aid of the type of technology employed in the making of various cups, with the various features of the subject invention being added or realized in the course of such manufacture or in extensions thereof. Similarly, the paint shield 115 may be made in the manner of a collapsible cup, with the features of the subject invention being again added or implemented as desired necessary.

However, the best mode presently known to me for carrying out my invention is to provide the paint shield opening 28 by an annular elastic lip 46 or 47 tapering toward that opening for accommodating any of the objects 13 and 17 of different diameters. Any of these objects are then shielded by pushing the annular elastic lip 46 or 47 onto any of the raised objects 13 or 17 thereby expanding the annular elastic lip at the opening 28 in diameter to any of the different diameters of the objects 13 and 27 and exerting with that pushed elastic lip a gripping action supporting the paint shield on any of these different objects.

Paint may then be applied to the surface adjacent the latter object. The annular lip is elastically returned to an initial diameter 34 at the opening 28 upon removal of the paint shields from objects 13 and 17.

If desired, paint shields according to embodiments of the subject invention may be manufactured so as to touch a second portion of the raised object to be shielded or a part thereof, for added support and retentivity of the shield. For instance, paint shields may be dimensioned to touch the outer portion of the raised object 16, as may be noted from FIGS. 8 and 12. Contrariwise, such contact may be avoided in practice when it is desired to render the paint shield more versatilely applicable.

The front portion of any of the disclosed paint shields may be provided with an adhesive at their opening or front rim portion, to render the paint shield releasably attachable to a surface or object.

According to the illustrated preferred embodiments thereof, the invention resides in devices for shielding a raised object 13 of specific geometrical shape during painting of a surface 12 surrounding such raised object and, in particular, resides in paint shields, being self-supporting apart from the object 13 and having a wall extending about the mentioned geometrical shape. In particular, as seen in FIGS. 3, 5, 7, 10,12 and 15, each paint shield may have a hollow-cylindrical wall portion, at least when set on the object 13 or 17, adapted to extend to the surface 12 at right angles or perpendicularly thereto and having a uniform diameter corresponding to the diameter of the particular circular object 13 or 17, so that the hollow-cylindrical wall portion is adapted to grip the raised object 13 uniformly around the circumference of such raised objects whereby the paint shield is settable with its wall portion on the raised object 13 for self-supporting retention thereon.

The subject extensive disclosure suggests or renders apparent to those skilled in the art, various modifications and variations within the spirit and scope of the subject invention and equivalents thereof.

I claim:

1. In a method of applying paint to any surface surrounding raised circular objects having different diameters, the improvement comprising in combination the steps of:

providing apart from said objects a self-supporting paint shield having at an end thereof an opening for receiving said objects, said opening being provided by an annular elastic lip tapering toward said opening for accommodating any of said objects;

shielding any of said objects with said paint shield by pushing said annular elastic lip onto any of said raised objects thereby expanding said annular elastic lip at said opening in diameter to any of said different diameters and exerting with said pushed elastic lip a gripping action supporting said paint shield on any of said objects;

applying paint to the surface adjacent the latter object and exclusive of the latter shielded object; and elastically returning said annular lip to an initial diameter at said opening upon removal of said paint shield from any of said objects.

2. In a method of applying paint to a surface surrounding a raised circular object, the improvement comprising in combination the steps of:

providing apart from said object a self-supporting paint shield having at an end thereof an opening for receiving said object, said opening being provided by a continuously annular wall portion of said paint shield having a continuously annular lip tapering toward said opening for forming around said opening a tapering brim portion and having across said opening a diameter smaller than a diameter of said circular object, said annular lip being made elastically deformable to permit enlargement of said smaller diameter for adaptation of said annular lip to said object and being adapted to extend to said surface while in contact with said raised circular object at said end;

shielding said object with said paint shield by twisting said paint shield at said annular wall portion onto said raised object and advancing said tapering brim portion toward said surface thereby expanding said elastically deformable lip in diameter to said raised object and exerting with said continuously annular wall portion a gripping action supporting said paint shield on said raised object; and applying paint to said surface around said shielded object.

3. A method as claimed in claim 2, including the step of:

providing said tapering brim portion with a dull annular edge around said opening.

4. A method as claimed in claim 2, including the step of:

providing said tapering brim portion with a flat annular edge around said opening.

5. A method as claimed in claim 2, including the step of:

providing said tapering brim portion with a flat annular edge having a width of from 0.2 to 0.5 mm and extending around said opening.

6. A method as claimed in claim 2, including the step of:

providing said tapering brim portion with a flat annular edge extending in a radial plane adjacent said continuously annular wall portion.

7. A method as claimed in claim 2, including the step of:

providing said tapering brim portion with a flat annular edge extending radially from said opening for from 0.2 to 0.5 mm.

8. A method as claimed in claim 2, including the step of:

providing said tapering brim portion with a hollow-cylindrical edge extending around said opening.

9. A method as claimed in claim 2, including the step of:

providing said tapering brim portion with a hollow-cylindrical edge having a width of from 0.2 to 0.5 mm and extending around said opening.

10. A method as claimed in claim 2, including the step of:

spacing said paint shield on said raised object from said surface circumferentially around said raised object by a distance equal to a predetermined thickness of paint applied to said surface around said shielded object.

11. A method as claimed in claim 2, including the steps of:

providing said annular wall portion with a bevel extending in a continuous transition to said end for defining said tapering brim portion.

12. A method as claimed in claim 2, including the step of:

providing said paint shield with a body for enclosing said object behind said opening.

13. A method as claimed in claim 2, including the step of:

providing said body with an air escape hole therethrough.

14. A method as claimed in claim 2, including the step of:

providing said paint shield with a body for supporting said annular wall portion apart from said raised object.

15. A method as claimed in claim 2, including the steps of:

providing said paint shield with a body for supporting said annular wall portion apart from said raised object; and providing a circular indentation between said body and said annular wall portion.

16. A method as claimed in claim 2, including the steps of:

providing said paint shield with a body; and providing said annular wall portion as a continuously annular elastic lip of said body defining said opening.

17. A method as claimed in claim 2, including the steps of:

providing said paint shield with a circular body;

providing said circular body with said continuously annular elastically deformable lip as said annular wall portion; and providing said annular lip with a bevel extending in a continuous transition from said circular body to, and forming said tapering brim portion at, said free end.

18. A method as claimed in claim 17, including the step of:

providing an annular indentation between said annular lip and said circular body.

19. A method as claimed in claim 17, including the steps of:

providing said annular lip with an inner wall surface projecting at an angle to said circular body from a diameter of said circular body larger than said smaller diameter to said smaller diameter of said opening.

20. A method as claimed in claim 2, including the steps of:

providing said paint shield with a circular body for supporting said annular wall portion apart from said object; and providing said tapering brim portion with an inner wall surface projecting at an angle to said circular body from a diameter of said circular body larger than said smaller diameter to said smaller diameter across said opening.

21. In a method of applying paint to a surface surrounding a raised circular object, the improvement comprising in combination the steps of:

providing apart from said object a self-supporting paint shield;

providing said self-supporting shield with a hollow-cylindrical wall portion extending about said raised circular object at right angles to said surface;

providing said hollow-cylindrical wall portion with a uniform diameter corresponding to a diameter of said raised circular object so that said hollow-cylindrical wall portion is gripping said raised object whereby said shield is set with said hollow-cylindrical wall portion onto said raised object for self-supporting retention thereon;

providing said wall with a bevel extending to said surface when said shield with said wall is set onto said raised object; and applying paint to said surface while shielding said object with said set shield.

22. A method as claimed in claim 21, wherein:

said self-supporting shield is provided with a closed bottom.

23. In a method of applying paint to a surface surrounding a raised circular object, the improvement comprising in combination the steps of:

providing apart from said object a self-supporting paint shield;

providing said self-supporting shield with a cylindrical wall portion extending about said raised circular object at right angles to said surface;

providing said cylindrical wall portion with a uniform diameter corresponding to the diameter of said raised circular object so that said cylindrical wall portion is gripping said raised object whereby said shield is set with said cylindrical wall portion onto said raised object for self-supporting retention thereon;

providing said wall portion with a bevel extending to said surface when said shield with said wall portion is set onto said raised object; and applying paint to said surface while shielding said object with said set shield.

24. A method as claimed in claim 23, wherein:

said self-supporting shield is provided with a closed bottom.

25. In a method of applying paint to a surface surrounding a raised circular object, the improvement comprising in combination the steps of:

providing apart from said object a self-supporting paint shield;

providing said self-supporting shield with a cylindrical wall portion adaptable in diameter to said raised circular object;

providing said paint shield with a circumferential bevel extending in a continuous transition from an outer surface of said cylindrical wall portion to a circular opening of said wall portion adapted to be placed adjacent said surface surrounding said raised object;

gripping said raised object with said wall portion adaptable in said diameter whereby said shield is set with said wall portion onto said raised object for self-supporting retention thereon; and applying paint to said surface while shielding said object with said set shield.

26. A method as claimed in claim 25, wherein:

said cylindrical wall portion is provided with a uniform diameter for a gripping of said raised circular object uniformly around the circumference of said raised circular object.

27. A method as claimed in claim 25, wherein:

said paint shield is provided with a taper extending in a direction away from said bevel.

28. A method as claimed in claim 25, wherein:

said self-supporting shield is provided with a closed bottom.

29. In a method of applying paint to surfaces surrounding raised circular objects, the improvement comprising in combination the steps of:

providing self-supporting circular paint shields;

providing each of said paint shields with a taper and with a hollow-cylindrical wall portion opposite said taper adapted to extend to any of said surfaces at right angles thereto;

providing said hollow-cylindrical wall portion of each paint shield with a uniform diameter corresponding to a diameter of said raised circular objects so that the hollow-cylindrical wall portion is capable of gripping any of said raised objects uniformly around the circumference thereof;

providing said hollow-cylindrical wall portion of each paint shield with a circumferential bevel extending in a continuous transition from a cylindrical outer surface of the hollow-cylindrical wall portion to a circular opening of said wall portion adapted to be placed adjacent any of said surfaces surrounding said raised objects;

stacking said tapered paint shields onto each other;

removing said stacked paint shields from each other;

gripping said raised circular objects with the hollow-cylindrical wall portions of said removed paint shields wherby said removed paint shields are set onto raised circular objects for self-supporting retention thereon, to cover each of said objects at least laterally; and applying paint to said surfaces exclusive of said covered objects.

30. A method as claimed in claim 29, wherein:

said paint shields are provided with closed bottoms.

31. In a method of applying paint to a surface surrounding a raised circular object, the improvement comprising in combination the steps of:

composing a paint shield of nested paint shield elements;

making one of said elements to extend about said raised circular object;

providing said one element with a hollow-cylindrical wall portion adapted to extend to said surface at right angles thereto and with a uniform diameter corresponding to the diameter of said raised circular object so that said hollow-cylindrical wall portion is adapted to grip said raised object uniformly around the circumference of said raised object for self-supporting retention thereon;

storing said paint shield in a collapsed position wherein said elements are located inside each other;

extending said paint shield to an expanded position wherein said elements jointly form a wall structure;

shielding said raised object with said wall structure in said expanded position of the paint shield by setting said wall structure with said hollow-cylindrical wall portion onto said raised circular object; and applying paint to said surface exclusive of said shielded object.

32. A method as claimed in claim 31, wherein:

said one element is provided with a bevel extending to said surface during shielding of said raised object.

33. A method as claimed in claim 31, wherein:

the innermost of said nested elements is provided with a closed bottom.

34. In a method of applying paint to a surface surrounding a raised circular object, the improvement comprising in combination the steps of:

composing a paint shield of nested paint shield elements;

making one of said elements to extend about said raised circular object;

providing said one element with a hollow-cylindrical wall portion adapted to extend to said surface at right angles thereto and with a uniform diameter corresponding to the diameter of said raised circular object so that said hollow-cylindrical wall portion is adapted to grip said raised object uniformly around the circumference of said raised object for self-supporting retention thereon;

providing said hollow-cylindrical wall portion with a circumferential bevel extending in a continuous transition from a cylindrical outer surface of said hollow-cylindrical wall portion to a circular opening of said wall portion adapted to be placed adjacent said surface around said raised object;

storing said paint shield in a collapsed position wherein said elements are located inside each other;

extending said paint shield to an expanded position wherein said elements jointly form a wall structure;

gripping said raised circular object with said hollow-cylindrical wall portion uniformly around the circumference of said raised circular object whereby said extended paint shield is set with said wall portion onto said raised object for self-supporting retention of said wall structure thereon; and applying paint to said surface while shielding said object with said set shield.

35. A method as claimed in claim 34, wherein:

the innermost of said nested elements is provided with a closed bottom.

36. A device for shielding raised circular objects having different diameters, while painting any adjacent surface, comprising in combination:

a paint shield having a circular outer surface and being self-supporting apart from said objects and having at an end thereof an opening for receiving said objects, said paint shield having an annular elastic lip tapering toward said opening for accommodating any of said objects by expanding at said opening in diameter to any of said different diameters and exerting with said expanded elastic lip a gripping action supporting said paint shield on any of said objects, and for elastically returning said lip to an initial diameter at said opening upon removal of said paint shield from any of said objects, and said annular lip has a circumferential bevel extending in a continuous transition from said circular outer surface to said opening for receiving said raised objects.

37. A device for shielding a raised circular object surrounded by a surface to be painted, comprising in combination:

a paint shield having a circular outer surface and being self-supporting apart from said object and having at an end thereof a continuously annular wall portion defining an opening for receiving said object, said annular wall portion comprising a continuously annular elastic lip having around said opening a tapering brim portion and having across said opening a diameter smaller than a diameter of said circular object, and said annular wall portion being expandable in diameter to said raised object and being adapted to extend with said tapering brim portion toward said surface while in contact with said raised circular object at said end, whereby to exert a gripping action supporting said paint shield on said object; and said elastic lip has a circumferential bevel extending as said brim portion in a continuous transition from said circular outer surface to said opening of said wall portion for receiving said raised object.

38. A device as claimed in claim 37, wherein:

said continuously annular wall portion is adapted to expand in diameter when twisted onto said circular object.

39. A device as claimed in claim 37, wherein:

said paint shield has a circular body for supporting said annular wall portion apart from said object;

said annular wall portion is adapted to expand in diameter when twisted onto said circular object; and said tapering brim portion has an inner wall surface projecting at an angle to said circular body from a diameter of said circular body larger than said smaller diameter to said smaller diameter at said opening for receiving said object.

40. A device as claimed in claim 37, wherein:

said paint shield has a body for enclosing said object behind said opening.

41. A device as claimed in claim 40, wherein:

said body has an air escape hole therethrough.

42. A device as claimed in claim 37, wherein:

said paint shield has a body for supporting said annular wall portion apart from said raised object.

43. A device as claimed in claim 37, wherein:

said paint shield has a body for supporting said annular wall portion apart from said raised object; and said paint shield has a circular indentation between said body and said annular wall portion.

44. A device as claimed in claim 37, wherein:

said tapering brim portion has a flat annular edge having a width of from 0.2 to 0.5 mm and extending around said opening.

45. A device as claimed in claim 37, wherein:

said tapering brim portion has a flat annular edge extending radially of said continuously annular wall portion.

46. A device as claimed in claim 37, wherein:

said tapering brim portion has a flat annular edge extending in a radial plane adjacent said opening for from 0.2 to 0.5 mm.

47. A device as claimed in claim 37, wherein:

said tapering brim portion has a hollow-cylindrical edge extending around said opening.

48. A device as claimed in claim 37, wherein:

said tapering brim portion has a hollow-cylindrical edge having a width of from 0.2 to 0.5 mm and extending around said opening.

49. A device for shielding a raised circular object surrounded by a surface to be painted, comprising in combination:

a paint shield having a circular body with a circular outer surface, being self-supporting apart from said object, and having a continuously annular lip at an end thereof;

said annular lip defining an opening having a diameter smaller than a diameter of the circular object;

said annular lip having a bevel extending in a continuous transition from said circular outer surface of the cylindrical body to, and having a tapering brim at, a free end of said annular lip; and said annular lip being elasticaly deformable for enlargement of said smaller diameter and adaptation of said annular lip to said object in self-supporting gripping action therewith at said surface.

50. A device as claimed in claim 49, including:

an annular indentation between said annular lip to said circular body.

51. A device as claimed in claim 49, wherein:

said tapering brim has an inner wall surface projecting at an angle to said circular body from a diameter of said circular body larger than said smaller diameter to said smaller diameter of said opening.

52. A device for shielding a raised circular object during painting of a surface surrounding said raised object, comprising:

a paint shield being self-supporting apart from said object and having a cylindrical wall portion adapted to extend when set on said object to said surface at right angles thereto and having a uniform diameter corresponding to the diameter of said raised circular object so that said cylindrical wall portion is adapted to grip said raised object uniformly around the circumference of said raised object whereby said shield is settable with said wall portion onto said raised object for self-supporting retention thereon;

said paint shield having a circumferential bevel extending in a continuous transition from a cylindrical outer surface of said hollow-cylindrical wall portion to a circular opening of said wall portion adapted to be placed adjacent said surface surrounding said raised object.

53. Apparatus for shielding raised circular objects during painting of surfaces surrounding said raised objects, comprising:

self-supporting circular paint shields having a taper, and being releasably stacked onto each other;

each of said paint shields having a hollow-cylindrical wall portion opposite said taper adapted to extend to any of said surfaces at right angles thereto and having a uniform diameter corresponding to a diameter of any of said raised objects so that said hollow-cylindrical wall portion is adapted to grip one of said raised objects uniformly around the circumference of the raised object whereby the particular shield is settable onto the particular raised object for self-supporting retention thereon; and each of said paint shields having a circumferential bevel extending in a continuous transition from a cylindrical outer surface of the hollow-cylindrical wall portion to a circular opening in that wall portion adapted to be placed adjacent any of said surfaces surrounding said raised object.

54. A device for shielding a raised circular object during painting of a surface surrounding said raised object, comprising:

a paint shield composed of nested paint shield elements, including an outer element having a hollow-cylindrical wall portion adapted to extend to said surface at right angles thereto and having a uniform diameter corresponding to the diameter of said raised circular object so that said hollow-cylindrical wall portion is adapted to grip said raised object uniformly around the circumference of said raised object for self-supporting retention thereon;

said outer element having a circumferential bevel extending in a continuous transition from a cylindrical outer surface of said hollow-cylindrical wall portion to a circular opening of said wall portion adapted to be placed adjacent said surface during shielding of said raised object; and said composed paint shield being storable in a collapsed position wherein said elements are located inside each other, and being extendable to an expanded position wherein said elements jointly form a shielding wall structure settable onto said raised object with said hollow-cylindrical wall portion.

55. A device as claimed in claim 54, wherein:

the innermost of said nested elements has a closed bottom.

* * * * *